US006504298B2

(12) United States Patent
Van Den Brink et al.

(10) Patent No.: US 6,504,298 B2
(45) **Date of Patent: *Jan. 7, 2003**

(54) PICTURE DISPLAY DEVICE WITH A CONICAL PORTION HAVING A PARTICULAR WALL THICKNESS

(75) Inventors: Jan P. Van Den Brink, Eindhoven (NL); Jan W. Kleine, Eindhoven (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/261,845

(22) Filed: Mar. 3, 1999

(65) Prior Publication Data

US 2002/0079825 A1 Jun. 27, 2002

(30) Foreign Application Priority Data

Mar. 9, 1998 (EP) ..... 98200746

(51) Int. Cl.[7] ..... H01J 29/88; H01J 31/00
(52) U.S. Cl. ..... 313/477 R; 313/479; 220/21 A
(58) Field of Search ..... 313/477 R, 479, 313/461; 220/2.1 A, 2.3 A, 2.1 R, 2.2

(56) References Cited

U.S. PATENT DOCUMENTS

| | | | | |
|---|---|---|---|---|
| 3,166,211 A | * | 1/1965 | M. Stel et al. | 220/2.1 A |
| 3,562,518 A | * | 2/1971 | Javorik | 313/85 |
| 3,746,904 A | * | 7/1973 | Torre | 313/356 |
| 4,659,872 A | | 4/1987 | Dery et al. | 174/117 A |
| 5,155,411 A | * | 10/1992 | Swank et al. | 313/477 R |
| 5,751,103 A | * | 5/1998 | Opresko et al. | 313/477 R |

FOREIGN PATENT DOCUMENTS

| | | | |
|---|---|---|---|
| DE | 9420366 | 7/1995 | H05K/3/32 |
| JP | 07254316 A | 10/1995 | H01B/13/00 |
| WO | WO9807174 | 2/1998 | H01J/29/86 |

* cited by examiner

*Primary Examiner*—Nimeshkumar D. Patel
*Assistant Examiner*—Karabi Guharay
(74) *Attorney, Agent, or Firm*—Ernestine C. Bartlett

(57) ABSTRACT

Picture display device with an evacuated tube comprising, around a longitudinal axis, a display window, a conical portion and a neck portion, said conical portion being connected to an upstanding wall of the display window. The conical portion has a reduced wall thickness. The conical portion is preferably provided with a coating having a layer thickness of preferably less than 50 $\mu$m. The coating preferably comprises a layer of polyurethane.

3 Claims, 2 Drawing Sheets

PICTURE DISPLAY DEVICE WITH A CONICAL PORTION HAVING A PARTICULAR WALL THICKNESS

CROSS REFERENCE TO RELATED APPLICATIONS

U.S. patent application Ser. No. 09/259,963 filed on Mar. 1, 1999 also relates to a picture display device having a conical portion.

BACKGROUND OF THE INVENTION

The invention relates to a picture display device comprising a display tube having an evacuated envelope, which envelope comprises, around a longitudinal axis, a display window with a display screen on its inner side, a conical portion and a neck portion, the conical portion being connected to an upstanding wall of the display window.

The invention also relates to a conical portion for use in a picture display device.

Picture display devices of the type described in the opening paragraph are used, inter alia, in television apparatuses and computer monitors and are referred to as cathode ray tubes (CRTs).

A picture display device of the type described in the opening paragraph is known.

The known picture display device has some drawbacks, notably a large weight and high cost price of its conical portion.

SUMMARY OF THE INVENTION

It is an object of the invention to provide a picture display device in which said problem is alleviated.

To this end, the picture display device according to the invention is characterized in that, along a diagonal in a direction from the neck portion to one of the corners of the display window, the wall thickness $d_{60\%}$ of the conical portion at a distance of 60% between the transition in the conical portion from at least substantially axial symmetry to a lower symmetry and the connection to the upstanding wall of the display window, which distance is measured with respect to the projection on the longitudinal axis, is defined by the relation $d_{60\%}=d_{se}-\alpha(d_{se}-d_{pa})$, in which coefficient $\alpha$ is in the range of $0.4<\alpha\leqq 1$, and in which $d_{se}$ is the wall thickness of the conical portion at the area of the transition between the conical portion and the upstanding wall, and $d_{pa}$ is the wall thickness of the conical portion at the area of said transition in the conical portion.

Since the wall thickness $d_{60\%}$ of the conical portion is thinner than that of the conical portion of the known picture display device, a conical portion comprising less material (glass) is obtained. Due to the reduction of the quantity of material, the picture display device as a whole will be less heavy. A reduction in weight of picture display devices is notably important for picture display devices having a relatively large picture diameter, because such apparatuses can otherwise be hardly lifted. The measure according to the invention may be used to advantage, notably for picture display devices having a large deflection angle (>100°). For picture display devices having such large deflection angles, the tensions in the glass of the conical portion are relatively high. To compensate for such high tensions, thicker glass is generally used. Due to the measure according to the invention, such an increase of the quantity of material used is not necessary in picture display devices having a large deflection angle (>100°). The weight reduction of the conical portion has the additional advantage that the picture display device as a whole thus has a lower cost price.

The conical portion is provided as a kind of linking element between the neck portion of the known picture display device, which neck portion usually has a relatively small wall thickness, and the upstanding wall of the display window, which upstanding wall has a relatively large wall thickness (inter alia, dependent on the diameter of the display window, the glass composition and requirements imposed on the permeability to X-rays), the wall thickness of the conical portion, measured from the neck portion in the direction of the upstanding wall, generally increasing gradually. The neck portions generally has an axially symmetrical shape with respect to the longitudinal axis, whereas (the upstanding wall of) the display window has a lower, for example at least substantially fourfold symmetry. Viewed from the neck portion, a first portion of the conical portion generally also has a substantially axially symmetrical shape with respect to the longitudinal axis. The (at least substantially axially symmetrical) deflection unit is generally arranged around this first part of the conical portion. A second part of the conical portion has a lower, for example, an at least substantially fourfold symmetry with respect to the longitudinal axis.

The thickness variation of the conical portion is different for the various directions in which the upstanding wall of the display window is reached from the neck portion. Generally, three main directions can be distinguished, namely the thickness variation of the conical portion along a cross-section of the conical portion parallel to the diagonal (to one of the corners of the display window), the thickness variation along a cross-section of the conical portion parallel to the short axis (to the upper or lower side of the display window), and the thickness variation along a cross-section of the conical portion parallel to the long axis (to the sides of the display window). Unless otherwise stated explicitly, the thickness variation of the conical portion in this application is measured in a direction from the neck portion to one of the corners of the display window of the picture display device, which direction is denoted as the direction "along the diagonal".

The relevant area of the conical portion to which said percentage in the above-mentioned relation for $d_{60\%}$ is applicable only comprises the second, lower symmetrical part of the conical portion. The thickness $d_{pa}=d_{0\%}$ (see FIG. 1B) is the wall thickness of the conical portion at the area of the transition from at least substantially axial symmetry to a lower symmetry in the conical portion, which transition of curvature usually coincides with the end portion of the deflection unit facing the display window. The thickness $d_{se}=d_{100\%}$ is the wall thickness of the conical portion at the area of the transition of the conical portion to the upstanding wall of the display window. Generally, the conical portion is connected to the upstanding wall of the display window via the "seal edge". The intermediate values of the wall thickness $d_x$, in which $0\leqq x\leqq 100\%$, are determined with respect to the projection of the position on the longitudinal axis. Generally, the variation of the wall thickness $d_x$ is gradual. The longitudinal axis is scaled in percents by determining the intersection of the relevant conical portion with projection planes perpendicular to the longitudinal axis. At the position on the longitudinal axis x=0%, the projection plane intersects the transition from at least substantially axial symmetry to a lower, for example an at least substantially fourfold symmetry; at x=100%, the projection plane intersects the transition between the conical portion and the upstanding wall. At the position on the longitudinal axis x=60%, the intersection of the relevant projection plane perpendicular to the longitudinal axis with the conical portion is determined and the relevant wall thickness $d_{60\%}$ is measured at this position. Said wall thicknesses $d_{pa}$, $d_{se}$ and $d_{60\%}$ are measured perpendicularly to the curvature at the area of the wall.

A preferred embodiment of the picture display device according to the invention is characterized in that the coefficient $\alpha$ is in the range of $0.6 \leqq \alpha \leqq 1$. At values of the coefficient $\alpha$ in the range $\alpha \approx 0.6$, the conical portion can be manufactured (molded) satisfactorily, while a considerable quantity of material is saved. A particularly suitable value for the coefficient $\alpha$ is $\alpha \approx 0.9$. At such high values of the coefficient $\alpha$, the wall thickness $d_x$ of the conical portion in the range of $0 \leqq x \leqq 60\%$ is at least substantially the same as the wall thickness $d_{pa}$ at the area of the curvature transition.

In said range of $0.4 \leqq \alpha \leqq 1$, the picture display device meets the standards imposed on strength and durability of the materials. However, to improve the strength of the conical portion, a coating is provided on the conical portion in the area at which the coefficient is $\alpha \geqq 0.6$. The dynamic fracture behavior of the picture display device is improved thereby. The dynamic fracture behavior is herein understood to mean the fracture behavior upon implosion of the picture display device.

In the case where the measure according to the invention reduces the wall thickness of the conical portion at the area of the transition to the upstanding wall of the display window, it is desirable to reduce the wall thickness of the upstanding wall accordingly. By providing the coating on the upstanding wall of the display window, the desired strength of the upstanding wall is maintained. The coating is preferably provided both on the conical portion and on the upstanding wall of the display window. The coating is usually provided on the outer side of the relevant parts of the picture display device.

A particularly suitable material for use as a coating is a synthetic resin coating, for example a coating of polyurethane. The (polyurethane) coating preferably has a thickness of less than 50 $\mu$m. Experiments have surprisingly proved that such a relatively thin layer is already sufficient to maintain the desired strength of the material of the conical portion of the picture display device upon a reduction of the wall thickness of the conical portion according to the invention.

BRIEF DESCRIPTION OF THE DRAWING

In the drawings.

The Figures are purely diagrammatic and not to scale. For the sake of clarity, some dimensions have been greatly exaggerated. Similar components are denoted as much as possible by identical reference numerals in the Figures.

DETAILED DESCRIPTION OF THE INVENTION

Figure 1A:
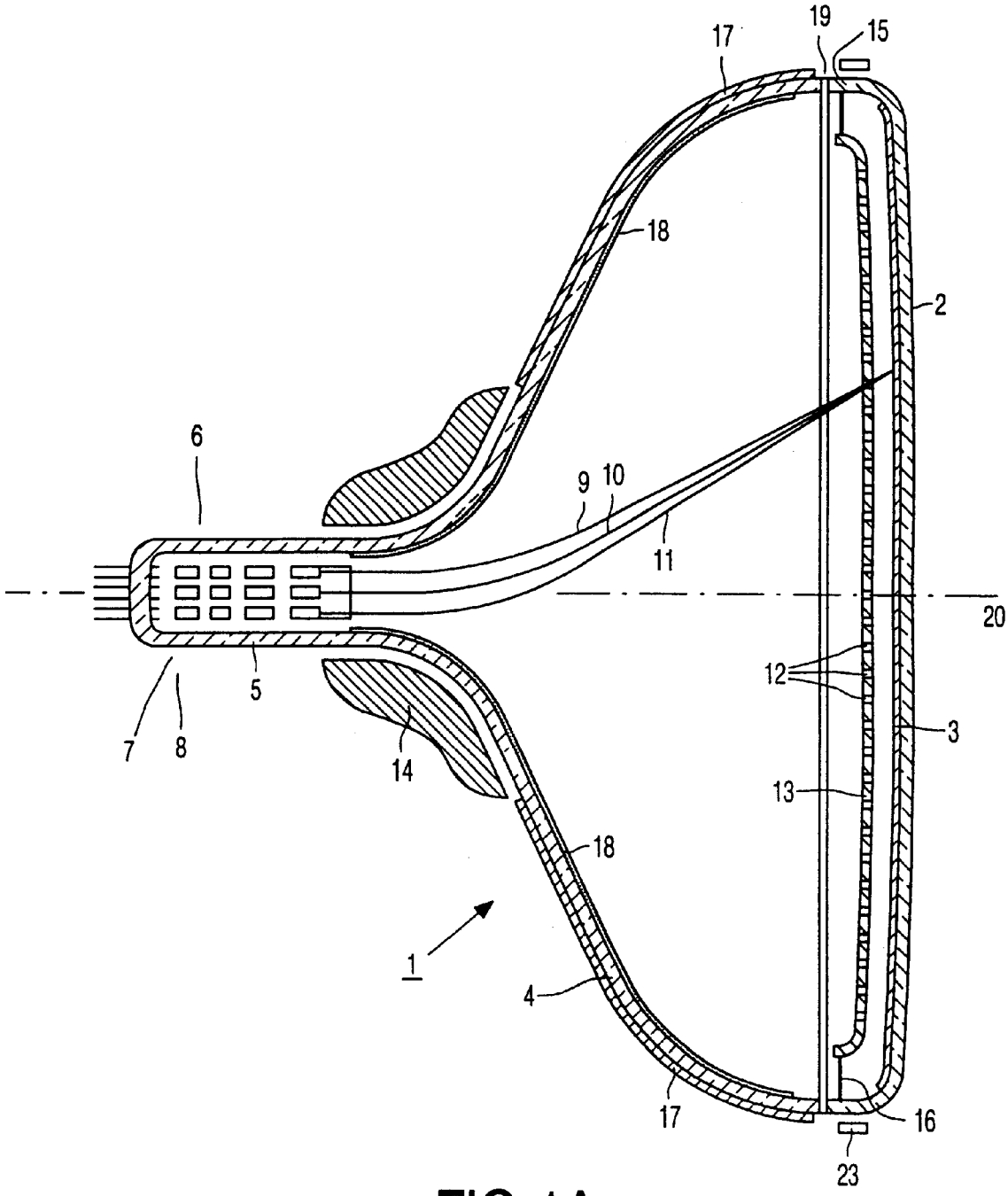
FIG. 1A is a cross-section of a picture display device comprising a cathode ray tube.

These and other aspects of the invention will be described in greater detail with reference to the figures of the drawing.

FIG. 1A is a diagrammatic cross-section of a picture display device comprising a cathode ray tube (CRT) having a longitudinal axis 20 and an evacuated envelope 1 comprising a display window 2, a conical portion 4 and a neck portion 5. In this embodiment, the neck portion 5 accommodates three electron guns 6, 7 and 8 for generating three electron beams 9, 10 and 11 which are usually co-planar, here the plane of the drawing. A display screen 3 is provided on the inner surface of the display window 2. The display screen 3 comprises a large number of red, green and blue-luminescing phosphor elements. On their way to the display screen 3, the electron beams 9, 10 and 11 are deflected in two mutually perpendicular directions (the field and line deflection direction) by the deflection unit 14 across the display screen 3 and pass a color selection electrode 13 arranged in front of the display window 2, which electrode usually consists of a thin plate having apertures 12 and is referred to as shadow mask in this case. The color selection electrode 12 is suspended to the inner side of the upstanding wall 15 of the display window 2 with the aid of suspension means 16. The transition between the conical portion 4 and the upstanding wall 15 of the display window 2 is also referred to as the "seal edge" 19 where a (glass) frit is present, which frit serves as a sealing material. The three electron beams 9, 10 and 11 pass the apertures 12 of the color selection electrode 13 at different angles and thus each impinge on phosphor elements of one color only. The inner side of the conical portion 4 is usually coated with a conducting coating 18. In the embodiment shown in FIG. 1A, the conical portion 4 is provided with a coating 17 on its outer side, as shown in an embodiment according to the invention. Such a coating improves the mechanical properties and the dynamic strength (fracture behavior) of the conical portion 4. Notably in the area where the coefficient $\alpha \geqq 0.6$, the provision of the coating on the conical portion improves the dynamic fracture behavior of the picture display device. This coating may also be provided on the upstanding wall 15 of the display window 2. If desired, the coating may also extend on the outer side of the picture display device on the display window 2. Furthermore, the coating is often also provided under or over the rimband 23 of the picture display device. Usually, a glass fiber tape (not shown in FIG. 1B) is present under the rimband 23: when the coating is provided under the rimband 23, this glass fiber tape may be omitted, which yields a further reduction of the cost price of the picture display device.

Figure 1B:
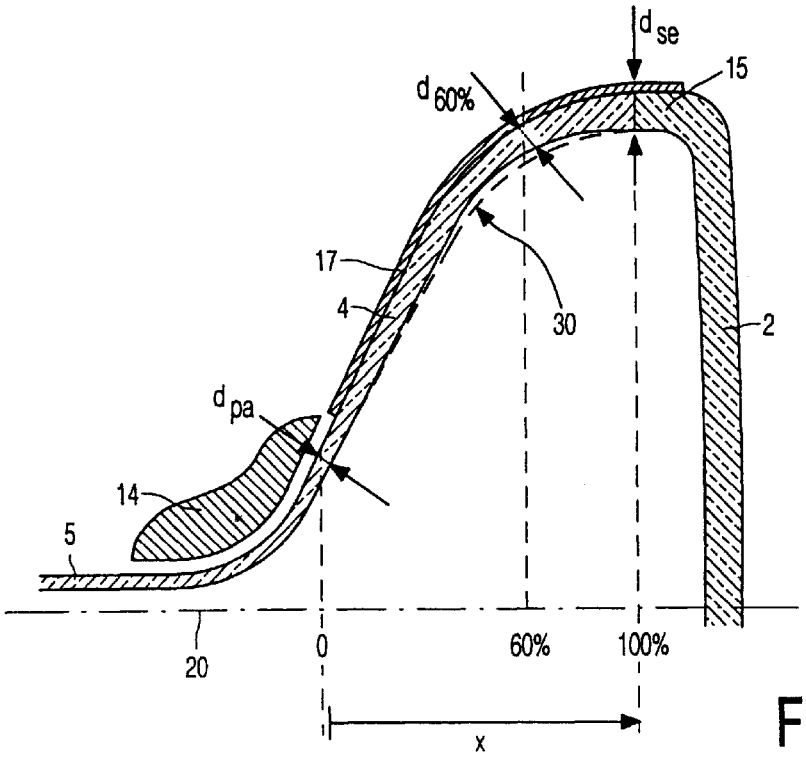
FIG. 1B is a cross-section of a part of the conical portion of the cathode ray tube shown in FIG. 1A according to the invention.

FIG. 1B is a diagrammatic cross-section of a part of the conical portion of the cathode ray tube shown in FIG. 1A according to the invention. In this Figure, a number of components shown in FIG. 1A has been omitted for the sake of clarity. FIG. 1B shows an example of a thickness profile of the wall of the conical portion 4 according to the invention. The broken line 30 indicates the thickness profile of the wall of the conical portion in the known picture display device. In the example of FIG. 1B, the coating 17 is also provided on the upstanding wall 15 of the display window 2 of the display device.

The neck portion 5 usually has a relatively small wall thickness (typical thicknesses are 3–6 mm), whereas the upstanding wall 15 of the display window 2 usually has a relatively large wall thickness (typical thicknesses are 7–12 mm). The wall thickness of the upstanding wall 15 is dependent on the diameter of the display window 2 and on the permeability to X-rays of the material used. The wall thickness of the conical portion, measured from the neck portion, gradually increases towards the upstanding wall 15. Viewed from the neck portion 5, a first part of the conical portion 4 has an at least substantially axially symmetrical shape with respect to the longitudinal axis 20. The (at least substantially axially symmetrical) deflection unit 14 is generally arranged around this first part of the conical portion. The conical portion 4 is often provided at the area of the deflection unit 14 with ducts on its inner side for increasing the effective deflection angle of the picture display device. Said first part of the conical portion 4 is generally perfectly round, but in some picture display devices, the first part of the conical portion 4 has a certain extent of out-of-roundness, to which the shape of the deflection unit 14 is adapted. It is alternatively possible to implement this first part in a fourfold symmetry. A second part of the conical portion 4 has an at least substantially fourfold symmetry with respect to the longitudinal axis (and oriented with respect to the at least substantially rectangular shape of the display window 2). The curvature transition in the conical portion from at least a substantially axial symmetry to a lower, for example at least substantially fourfold symmetry is also referred to as "top of round" by those skilled in the art. Said curvature transition usually coincides with the end portion of the deflection unit 14 facing the display window 2, and referred to as "outward flaring flange of the deflection unit".

According to the invention, the wall thickness $d_{60\%}$ of the conical portion is defined by the relation $d_{60\%}=d_{se}-\alpha(d_{se}-d_{pa})$, in which the coefficient $\alpha$ is situated in a given range. For a good understanding of this relation, the relevant wall thicknesses occurring in this relation are indicated in FIG. 1B. The thickness $d_{pa}$ is the wall thickness of the conical portion 4 at the area of the curvature transition in the conical portion 4 from at least substantially axial symmetry to at least substantially fourfold symmetry and is denoted by x=0% on the longitudinal axis in FIG. 1B. The thickness $d_{se}$ is the wall thickness of the conical portion 4 at the area of the transition between the conical portion 4 and the upstanding wall 15 of the display window 2 and is denoted by x=100% on the longitudinal axis in FIG. 1B. Generally, $d_{se}$ is at least substantially equal to the wall thickness of the upstanding wall 15 at the area of the transition between the upstanding wall 15 and the conical portion 4. The intermediate values of the wall thickness $d_x$, at which $0\leqq x\leqq 100\%$ ($d_{pa}=d_{0\%}$ and $d_{se}=d_{100\%}$) are determined with respect to the projection of the position on the longitudinal axis 20. The longitudinal axis is scaled in percents by determining the intersection of the relevant conical portion with projection planes perpendicular to the longitudinal axis 20 (said projection planes are diagrammatically shown by way of three broken lines perpendicular to the longitudinal axis in FIG. 1B). At the position on the longitudinal axis 20 corresponding to x=0%, the projection plane intersects said curvature transition (end of deflection unit), at x=100%, the projection plane intersects the transition between the conical portion 4 and the upstanding wall 15. At the position on the longitudinal axis x=60%, the intersection of the relevant projection plane perpendicular to the longitudinal axis 20 with the conical portion 4 is determined, and the relevant wall thickness $d_{60\%}$ is measured at this position. The wall thicknesses $d_{pa}$, $d_{se}$ and $d_{60\%}$ of the conical portion 4 are measured perpendicularly to the curvature at the area of the wall (instead of in alignment with the projection plane perpendicular to the longitudinal axis).

FIG. 1B shows the conical portion 4 from the transition of at least substantially axial symmetry up to and including the upstanding wall 15 of the display window, provided with a coating 17 on its outer side. The coating 17 preferably has a thickness of less than 50 $\mu$m. A particularly suitable material for use as a coating is a synthetic resin coating of polyurethane. Such a coating is provided by means of spraying, brushing, molding or immersion on the relevant part of the picture display device.

Figure 2:
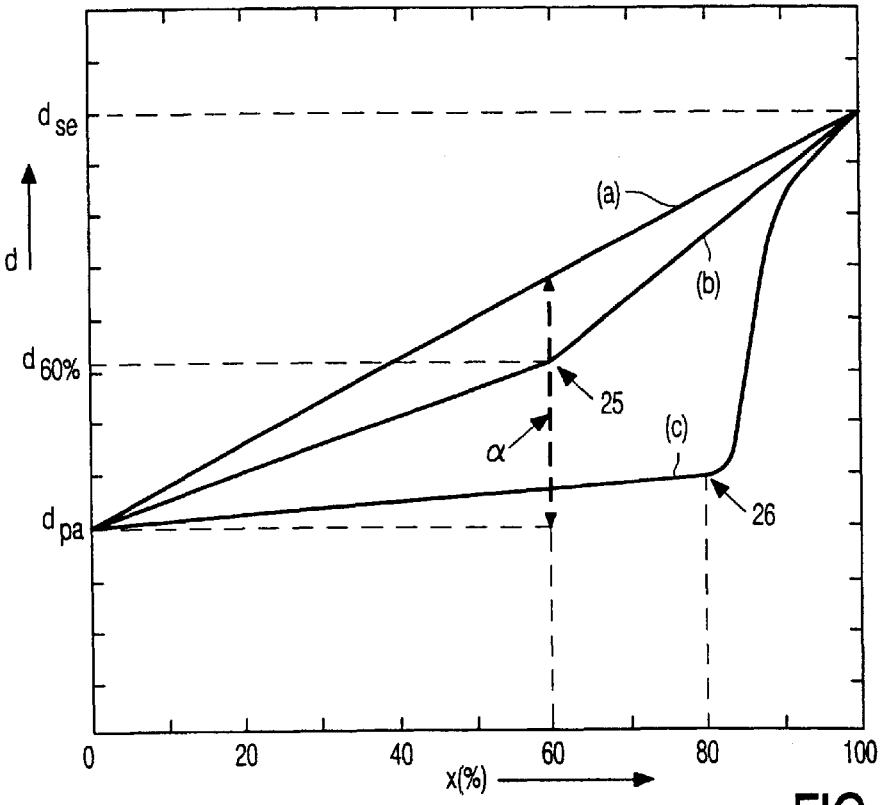
FIG. 2 shows a graph of the wall thickness of the conical portion according to the invention, as a function of the relative distance.

FIG. 2 shows graphs of the wall thickness of the known conical portion 4 and of the conical portion 4 according to the invention as a function of the relative distance. Plotted on the vertical axis is the wall thickness d of the conical portion 4 between said curvature transition and the thickness at the transition to the upstanding wall 15 as a function of the relative position x (in percent) on the longitudinal axis 20. As indicated above, $d_{pa}$ corresponds to x=0% and $d_{se}$ corresponds to x=100% (in the example of FIG. 2, $d_{pa}$=4 mm and $d_{se}$=12 mm). Curve (a) represents the (linear) variation of the thickness in the conical portion of the known picture display device. Curve (b) shows the variation of the thickness of the wall of the conical portion 4 according to the invention, in which the coefficient $\alpha$=0.6. In curve (b), there is a kink at x=60%, which kink is denoted by reference numeral 25 in FIG. 2 and at which kink the gradient of the wall thickness changes. The kink in curve (b) does not have to be at x=60% but may be chosen in the range of $30\leqq x\leqq 95\%$. With a view to the possibility of manufacturing (molding) the conical portion 4, it is desirable to situate the kink in curve (b) in the range of $50\leqq x\leqq 80\%$. An example of such a variation of the wall thickness of the conical portion is shown in curve (c) which depicts a variation of the thickness of the wall with the coefficient being at $\alpha\approx 0.9$. In curve (c), the gradient of the wall thickness of the conical portion is at least substantially constant for values of $x\leqq 80\%$ and the wall thickness $d_x$ is at least substantially equal to the wall thickness $d_{pa}$ at the area of the curvature transition. In curve (c), the direction coefficient of the wall thickness changes as a function of the relative distance x at x=80% (denoted by reference numeral 26 in FIG. 2). In curve (c) there is a gradual variation of the gradient of the wall thickness at values of x>80% so that a satisfactory transition between the conical portion and the upstanding wall 15 of the display window 2 is realized.

In FIG. 2, the range of the coefficient $\alpha$ according to the invention is shown for x=60%: $0.4<\alpha\leqq 1$. For the conical portion of the known picture display device, the coefficient is $\alpha$=0.4 at x=60%: curve (a) shows a gradual and linear increase of the wall thickness $d_x$ from $d_{pa}$ to $d_{se}$. The kink 25 in curve (b) corresponds to a value of the coefficient $\alpha$=0.6. For curve (c), the coefficient is $\alpha$=0.9 at x=60%.

In FIG. 2, curves (b) and (c) are situated under curve (a): the area enclosed by the curves (a) and (b) and, to a larger extent, the area enclosed by the curves (a) and (c) illustrate the saving of material in the conical portion. Such a reduction of the quantity of required material leads to a considerably lower cost price of the picture display device. A further saving of material is achieved by increasing the wall thickness less rapidly than in FIG. 2 in the area for values of x higher than the kink 25. A result of such a further reduction is that the wall thickness $d_{se}$ of the conical portion 4 at the area of the transition to the upstanding wall 15 of the display window 2 is smaller than the wall thickness of the upstanding wall 15 at the area of the transition to the conical portion 4. Such a mismatch in wall thicknesses of the conical portion 4 and the upstanding wall 15 at the area of the transition between the conical portion and the upstanding wall generally does not have a detrimental influence on the manufacture and realization of a satisfactory connection (by means of frit) between the conical portion and the upstanding wall. In an alternative possibility, the wall thickness of the upstanding wall 15 at the area of the transition to the conical portion 4 is adapted to the reduced wall thickness of the conical portion. Notably under such circumstances, it is desirable to provide the coating also on the outer side of the upstanding wall 15.

It will be evident that many variations within the scope of the invention can be conceived by those skilled in the art.

What is claimed is:

1. A picture display device having an evacuated envelope (1), which envelope comprises, around a longitudinal axis (20), a display window (2) with a display screen (3) on its inner side, a conical portion (4) and a neck portion (5), the conical portion being connected to an upstanding wall (15) of the display window (2), characterized in that, along a diagonal in a direction from the neck portion (5) to one of the corners of the display window (2), the wall thickness $d_{60\%}$ of the conical portion (4) at a distance of 60% between the transition in the conical portion from at least substantially axial symmetry to a lower symmetry and the connection to the upstanding wall (15) of the display window (2), which distance is measured with respect to the projection on the longitudinal axis (20), is defined by the relation:

$$d_{60\%}=d_{se}-\alpha(d_{se}-d_{pa}),$$

in which the coefficient $\alpha$ is in the range of $0.4 \leqq \alpha \leqq 1$, and in which $d_{se}$ is the wall thickness of the conical portion (4) at the area of the transition between the conical portion (4) and the upstanding wall (15), and $d_{pa}$ is the wall thickness of the conical portion (4) at the area of said transition in the conical portion, the conical portion (4) is provided with a coating (17) of a thickness of less than 50 $\mu$m where the value of the coefficient $\alpha$ is >0.6 and the upstanding wall (15) of the display window (2) is provided with the coating (17).

2. A picture display device as claimed in claim 1, characterized in that the coating (17) is a synthetic resin layer.

3. A picture display device as claimed in claim 1, characterized in that the coating (17) comprises a polyurethane.

* * * * *